US009309731B2

(12) United States Patent
Bedouet et al.

(10) Patent No.: US 9,309,731 B2
(45) Date of Patent: Apr. 12, 2016

(54) FORMATION TESTING PLANNING AND MONITORING

(75) Inventors: Sylvain Bedouet, Houston, TX (US); Julian Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 937 days.

(21) Appl. No.: 13/500,459

(22) PCT Filed: Oct. 5, 2010

(86) PCT No.: PCT/US2010/051385

§ 371 (c)(1), (2), (4) Date: Aug. 29, 2012

(87) PCT Pub. No.: WO2011/044070

PCT Pub. Date: Apr. 14, 2011

(65) Prior Publication Data

US 2012/0316788 A1 Dec. 13, 2012

Related U.S. Application Data

(60) Provisional application No. 61/248,925, filed on Oct. 6, 2009.

(51) Int. Cl.
*G01N 15/08* (2006.01)
*E21B 21/08* (2006.01)
(Continued)

(52) U.S. Cl.
CPC ..... *E21B 21/08* (2013.01); *E21B 33/124* (2013.01); *E21B 47/06* (2013.01); *E21B 47/065* (2013.01); *E21B 47/12* (2013.01); *E21B 49/008* (2013.01); *E21B 49/086* (2013.01)

(58) Field of Classification Search
CPC ..... G06F 19/22; E21B 21/08; E21B 49/008
See application file for complete search history.

(56) References Cited

U.S. PATENT DOCUMENTS 4,547,691 A 10/1985 Valdois et al.
4,860,581 A 8/1989 Zimmerman et al.
(Continued)

FOREIGN PATENT DOCUMENTS

WO 2008100156 A1 8/2008
WO 2009114463 A2 9/2009

OTHER PUBLICATIONS

Bamford, et al., "Well Control Simulation Interfaced with Real Rig Equipment to Improve Training and Skills Validation", SPE 27269—SPE Health, Safety and Environment in Oil and Gas Exploration and Production Conference, Jakarta, Indonesia, Jan. 25-27, 1994, pp. 547-556.
(Continued)

*Primary Examiner* — Phuong Huynh
(74) *Attorney, Agent, or Firm* — David G. Matthews; Cathy Hewitt

(57) ABSTRACT

An example method comprises collecting formation temperature data along a wellbore extending into a subterranean formation, determining test operating parameter values, performing a wellbore hydraulic simulation of the response of wellbore fluid conditions to the test operating parameter values and the formation temperature data, determining whether the response of wellbore fluid conditions is indicative of one of a well control and a well stability problem, and initiating a test based on the determination whether the response of wellbore fluid conditions is indicative of one of a well control and a well stability problem.

20 Claims, 6 Drawing Sheets

(51) Int. Cl.

| | |
|---|---|
| ***E21B 33/124*** | (2006.01) |
| ***E21B 47/06*** | (2012.01) |
| ***E21B 47/12*** | (2012.01) |
| ***E21B 49/00*** | (2006.01) |
| ***E21B 49/08*** | (2006.01) |
| *G06F 11/30* | (2006.01) |

(56) References Cited

U.S. PATENT DOCUMENTS

| | | | | |
|---|---|---|---|---|
| 5,394,345 | A | 2/1995 | Berard et al. | |
| 7,183,778 | B2 | 2/2007 | Homan et al. | |
| 7,197,398 | B2 * | 3/2007 | Azari | 702/13 |
| 7,379,180 | B2 | 5/2008 | Vannuffelen et al. | |
| 8,015,869 | B2 | 9/2011 | Nold, III et al. | |
| 2007/0137896 | A1 | 6/2007 | Villareal et al. | |
| 2008/0015781 | A1 * | 1/2008 | Niemeyer et al. | 702/11 |
| 2008/0037006 | A1 | 2/2008 | Canas Triana et al. | |
| 2008/0257036 | A1 | 10/2008 | Chaudoreille et al. | |
| 2009/0044951 | A1 | 2/2009 | Milkovisch et al. | |

OTHER PUBLICATIONS

Dong, et al., "New Downhole Fluid Analyzer Tool for Improved Reservoir Characterization", SPE 108566—Offshore Europe, Aberdeen, Scotland, UK, Sep. 4-7, 2007, pp. 1-11.

Gu, et al., "Development of a Computer Wellbore Simulator for Coiled-Tubing Operations", SPE 28222—Petroleum Computer Conference, Dallas, Texas, Jul. 31-Aug. 3, 1994, 14 pages.

Hernandez, et al., "Successful Application of Automated Choke MPD System to Prevent Salt Water Kicks While Drilling in a High-Pressure Tertiary Salt Diapir with OBM in Southern Mexico", SPE 122211—IADC/SPE Managed Pressure Drilling and Underbalanced Operations Conference & Exhibition, San Antonio, Texas, Feb. 12-13, 2009, pp. 1-14.

Lage, et al., "An Experimental and Theoretical Investigation of Upward Two-Phase Flow in Annuli", SPE 79512, SPE Journal, vol. 7(3), 2002, pp. 325-336.

Lima, et al., "Modeling of Transient Two-Phase Flow Operations and Offshore Pigging", SPE 49208—SPE Annual Technical Conference and Exhibition, New Orleans, Louisiana, Sep. 27-30, 1998, 9 pages.

Lorentzen, et al., "Underbalanced and Low-head Drilling Operations: Real Time Interpretation of Measured Data and Operational Support", SPE 71384—SPE Annual Technical Conference and Exhibition, New Orleans, Louisiana, Sep. 30-Oct. 3, 2001, pp. 1-12.

Martin, C.A. , "Wellsite Applications of Integrated MWD and Surface Data", SPE 14721—SPE/IADC Drilling Conference, Dallas, Texas, Feb. 10-12, 1986, 18 pages.

Oystein, et al., "An Integrated Approach to Risk and Hydraulic Simulations in a Well Control Planning Perspective", SPE 103853—IADC/SPE Asia Pacific Drilling Technology Conference and Exhibition, Bangkok, Thailand, Nov. 13-15, 2006, pp. 1-5.

Siswantoro, et al., "The Application of Modular Formation Dynamics Tester—MDT* with a Dual Packer Module in Difficult Conditions in Indonesia", SPE 54273—SPE Asia Pacific Oil and Gas Conference and Exhibition, Jakarta, Indonesia, Apr. 20-22, 1999, pp. 1-6.

* cited by examiner

FORMATION TESTING PLANNING AND MONITORING

BACKGROUND OF THE DISCLOSURE

The MDT (modular formation dynamics tester, trademark of Schlumberger Technology Corporation) is routinely run on TLC (tough logging conditions system, trademark of Schlumberger Technology Corporation) to perform mini DSTs (mini Drill Stem Tests).

Wellbore simulators are routinely used in oilfield operations. Examples of technical papers contemplating wellbore simulators include SPE Paper Number 14721 entitled "*Wellsite Applications of Integrated MWD and Surface Data*" by Martin, C. A., in SPE/IADC Drilling Conference, 9-12 Feb. 1986, Dallas, Tex.; SPE Paper Number 27269 entitled "*Well Control Simulation Interfaced With Real Rig Equipment To Improve Training and Skills Validation*" by Bamford, A. S., and Wang, Zhihua, in SPE Health, Safety and Environment in Oil and Gas Exploration and Production Conference, 25-27 Jan. 1994, Jakarta, Indonesia; SPE Paper Number 28222 entitled "*Development of a Computer Wellbore Simulator for Coiled-Tubing Operations*" by Gu, Hongren, and Walton, I. C., in Petroleum Computer Conference, 31 Jul.-3 Aug. 1994, Dallas, Tex.; SPE Paper Number 49208 entitled "*Modelling of Transient Two-Phase Flow Operations and Offshore Pigging*" by Lima, P. C. R., and Yeung, H., in SPE Annual Technical Conference and Exhibition, 27-30 Sep. 1998, New Orleans, La.; SPE Paper Number 71384 entitled "*Underbalanced and Low-head Drilling Operations: Real Time Interpretation of Measured Data and Operational Support*" by Rolf J. Lorentzen, Kjell Kåre Fjelde, Jonny Frøyen; Antonio C. V. M. Lage, Geir Nævdal, and Erlend H. Vefring, in SPE Annual Technical Conference and Exhibition, 30 Sep.-3 Oct. 2001, New Orleans, La.; SPE Paper Number 79512 entitled "*An Experimental and Theoretical Investigation of Upward Two-Phase Flow in Annuli*" by Antonio C. V. M. Lage, and Rune W. Time, in SPE Journal, Volume 7, Number 3, Pages 325-336, September 2002; SPE Paper Number 103853 entitled "*An Integrated Approach to Risk and Hydraulic Simulations in a Well-Control Planning Perspective*" by Øystein Arild, Kjell Kåre Fjelde, and Tove Løberg, in IADC/SPE Asia Pacific Drilling Technology Conference and Exhibition, 13-15 Nov. 2006, Bangkok, Thailand; and SPE Paper Number 122211 entitled "*Successful Application of Automated Choke MPD System to Prevent Salt Water Kicks While Drilling in a High-Pressure Tertiary Salt Diapir With OBM in Southern Mexico*" by J. Hernandez, C. Perez Tellez, C. Lupo, D. Scarcelli, N. Salinas, H. Bedino, F. Gallo, and O. SehSah, in IADC/SPE Managed Pressure Drilling and Underbalanced Operations Conference & Exhibition, 12-13 Feb. 2009, San Antonio, Tex.

Patent Application Pub. No. WO2008/100156 entitled "ASSEMBLY AND METHOD FOR TRANSIENT AND CONTINUOUS TESTING OF AN OPEN PORTION OF A WELL BORE" discloses an assembly for transient and continuous testing of an open portion of a well bore, said assembly being arranged in a lower part of a drill string, and is comprising: a minimum of two packers fixed at the outside of the drill string, said packers being expandable for isolating a reservoir interval; a down-hole pump for pumping formation fluid from said reservoir interval; a mud driven turbine or electric cable for energy supply to said down-hole pump; a sample chamber; sensors and telemetry for measuring fluid properties; a closing valve for closing the fluid flow from said reservoir interval; and a circulation unit for mud circulation from a drill pipe to an annulus above the packers and feeding formation fluid from said down-hole pump to said annulus. The sensors and telemetry are for measuring and real-time transmission of the flow rate, pressure and temperature of the fluid flow from said reservoir interval, from said down-hole pump, in the drill string and in an annulus above the packers. The circulation unit can feed formation fluid from said reservoir interval into said annulus, so that a well at any time can be kept in over balance and so that the mud in said annulus at any time can solve the formation fluid from said reservoir interval. The entire disclosure of Patent Application Pub. No. WO2008/100156 is incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
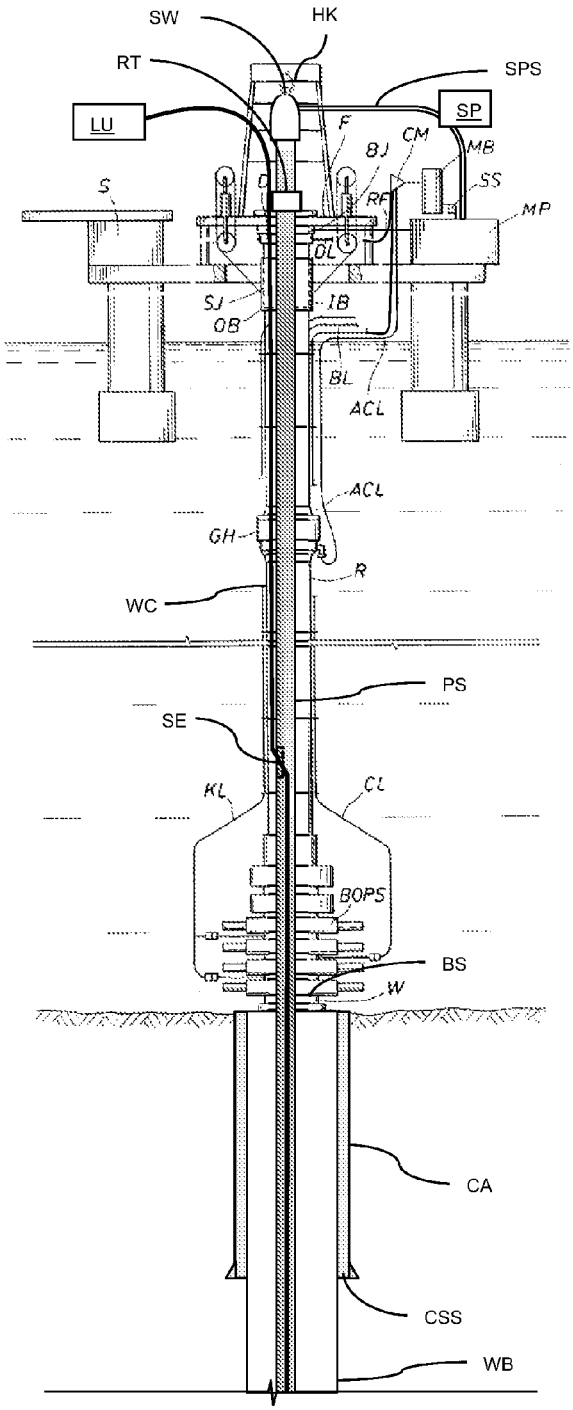
FIGS. 1A and 1B are schematic views of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to formation testing in open hole environment. Formation testing is routinely performed to evaluate underground reservoir. Formation testing typically includes a drawdown phase, during which a pressure perturbation is generated in the reservoir by pumping formation fluid out of the reservoir, and a build-up phase, during which pumping is stopped and the return of a sand-face pressure to equilibrium is monitored. Various reservoir parameters may be determined from the monitored pressure, such as formation fluid mobility in the reservoir and distances between the well being tested and flow barriers in the reservoir.

The present disclosure describes apparatus and methods that facilitate performing formation testing in open hole. The apparatus and methods described herein may alleviate well control while performing formation testing. For example, an apparatus according to one or more aspects of the present disclosure may comprise a formation testing assembly configured to permit a hydraulic bladder or packer of a blow-out-preventer or of a similar device to be closed around the formation testing assembly during formation testing, thereby sealing a well annulus. A method according to one or more aspects of the present disclosure may involve circulating drilling mud into a bore of the formation testing assembly down to a downhole circulation sub or unit and back up through the well annulus during at least a portion of a formation test. A formation fluid pumped from the reservoir may be mixed downhole with the circulated drilling mud according to suitable proportions. The mixture of pumped formation fluid and drilling mud may be circulated back to a surface separator via a choke line and/or a kill line towards a choke manifold. Wellbore sensors may be provided to interpret more accurately formation testing measurements.

The apparatus and methods described herein permit to plan and/or monitor a formation testing test. In a planning phase, initial operating parameter values and/or the testing tool configuration are selected so that the measurement objective of the formation test are met, that is, the interpretation of the measurements is likely to provide reliable values of reservoir characteristics. Also, the initial operating parameter values are selected so that the formation test is performed in a safe manner. In a monitoring phase, the expected well behavior predicted during the planning phases is compared to actual data, and the initial operating parameters may be tuned to the actual data. In some cases, unsafe situations may be detected early on and remedial action may be taken.

FIG. 1A shows an offshore well site according to the present disclosure. The well site can however be onshore. The well site system is disposed above an open hole wellbore WB that is drilled through subsurface formations. However, part of the wellbore WB may be cased using a casing CA.

The well site system includes a floating structure or rig S maintained above a wellhead W. A riser R is fixedly connected to the wellhead W. A conventional slip or telescopic joint SJ, comprising an outer barrel OB affixed to the riser R and an inner barrel IB affixed to the floating structure S and having a pressure seal therebetween, is used to compensate for the relative vertical movement or heave between the floating rig and the riser R. A ball joint BJ may be connected between the top inner barrel IB of the slip joint SJ and the floating structure or rig S to compensate for other relative movement (horizontal and rotational) or pitch and roll of the floating structure S and the fixed riser R.

Usually, the pressure induced in the wellbore WB below the sea floor is only that generated by the density of the drilling mud held in the riser R (hydrostatic pressure). The overflow of drilling mud held in the riser R may be controlled using a rigid flow-line RF provided about the level of the rig floor F and below a bell-nipple. The rigid flow-line RF may be communicating with a drilling mud receiving device such as a shale shaker SS and/or the mud pit MP. If the drilling mud is open to atmospheric pressure at the rig floor F, the shale shaker SS and/or the mud pit MP may be located below the level of the rig floor F.

During some operations (such as when performing formation testing in open hole), gas can unintentionally enter the riser R from the wellbore WB. One or more of a diverter D, a gas handler and annular blow-out preventer GH, and a blow-out preventer stack BOPS may be provided. The diverter D, the gas handler and annular blow-out preventer GH, and/or the blow-out preventer stack BOPS may be used to limit gas accumulations in the marine riser R and/or to prevent low pressure formation gas from venting to the rig floor F. The diverter D, the gas handler and annular blow-out preventer GH, and/or the blow-out preventer stack BOPS, may not be used when a pipe string such as pipe string PS is manipulated (rotated, lowered and/or raised) in the riser R, and may only be activated when indications of gas in the riser R are observed and/or suspected.

The blow-out preventer stack BOPS may be provided between a casing string CS or the wellhead W and the riser R. The blow-out preventer stack BOPS may be provided with one or more ram blow-out preventers. In addition, one or more annular blow-out preventers may be positioned in the blow-out preventer stack BOPS above the ram blow-out preventers. When activated, the blow-out preventer stack BOPS may provide a flow path for mud and/or gas away from the rig floor F, and/or to hold pressure on the wellbore WB. For example, the blow-out preventer stack BOPS may be in fluid communication with a choke line CL and a kill line KL connected between the desired ram blow-out preventers and/or annular blow-out preventers, as is known by those skilled in the art. The choke line CL may be configured to communicate with choke manifold CM. The drilling mud may then flow from the choke manifold CM to a mud-gas buster or separator MB and optionally to a flare line (not shown). The drilling mud may then be discharged to a shale shaker SS, and mud pits MP, or other drilling mud receiving device. In addition to the choke line CL, a kill line KL and/or a booster line BL may be used to return drilling mud and/or gas to the mud-gas buster or separator MB.

Figure 1B:
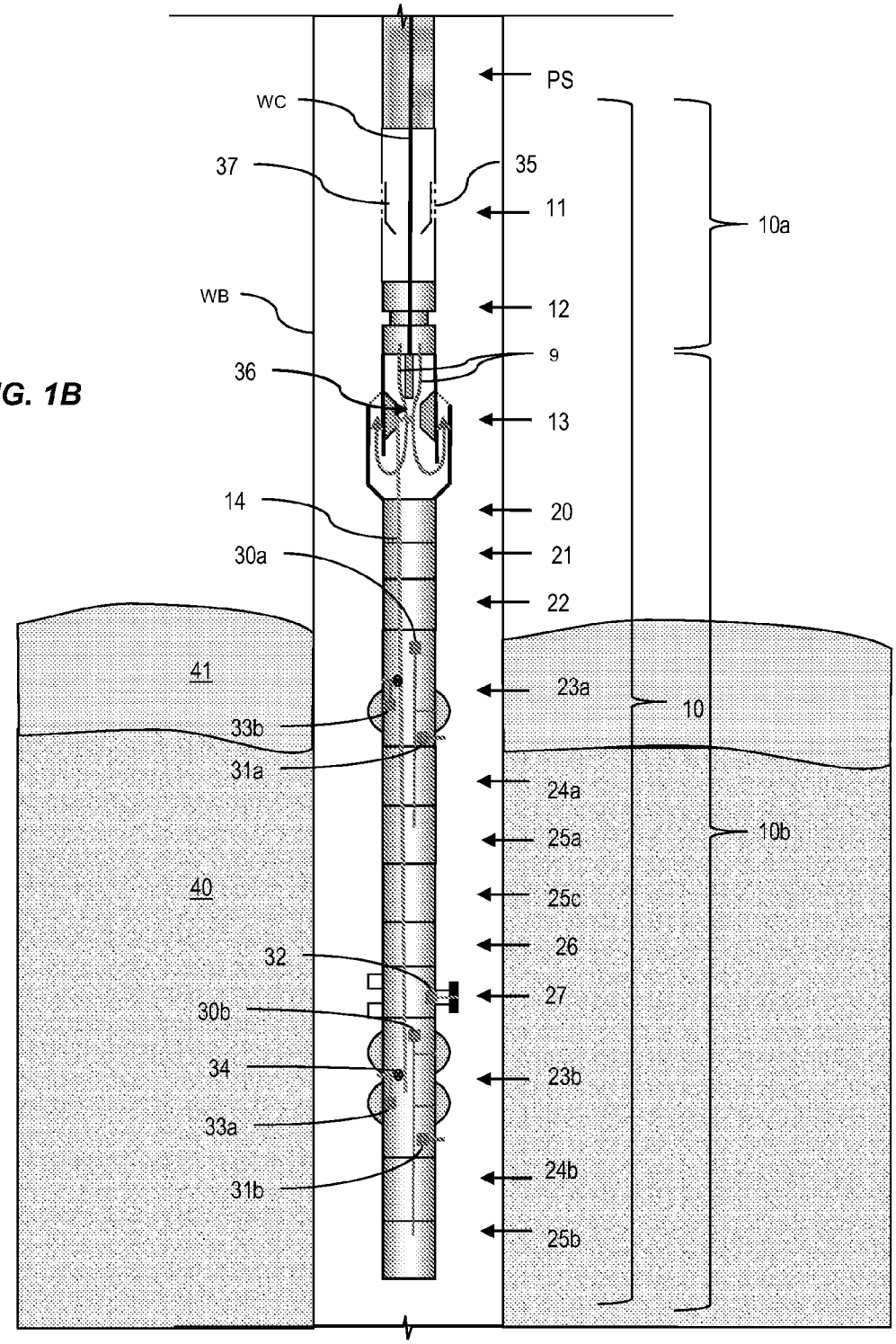

Referring collectively to FIGS. 1A and 1B, the well site system includes a derrick assembly positioned on floating structure or rig S. A drill string including a pipe string portion PS and a tool string portion at a lower end thereof (e.g., the tool string 10 in FIG. 1B) may be suspended in the wellbore WB from a hook HK of the derrick assembly. The hook HK may be attached to a traveling block (not shown), through a rotary swivel SW which permits rotation of the drill string relative to the hook. The drill string may be rotated by the rotary table RT, which is itself operated by well known means not shown in the drawing. For example, the rotary table RT may engage a kelly at the upper end of the drill string. As is well known, a top drive system (not shown) could alternatively be used instead of the kelly, rotary table RT and rotary swivel SW.

The surface system further includes drilling mud stored in a mud tank or mud pit MP formed at the well site. A surface pump SP delivers the drilling mud to an interior bore of the pipe string PS via a port in the swivel SW, causing the drilling mud to flow downwardly through the pipe string PS. The drilling mud may alternatively be delivered to an interior bore of the pipe string PS via a port in a top drive (not shown). The drilling mud may exit the pipe string PS via a fluid communicator configured to allow fluid communication with an annulus between the tool string and the wellbore wall, as indicated by arrow 9. The fluid communicator may comprise a jet pump. The jet pump may also be configured to mix the drilling mud with a formation fluid pumped from the formation, as further explained below. The drilling mud and/or the mixture of drilling mud and pumped formation fluid may then circulate upwardly through the annulus region between the outside of the drill string and the wall of the wellbore WB, whereupon the drilling mud and/or the mixture of drilling mud and pumped formation fluid may be diverted to one or more of the choke line CL, the kill line KL, and/or the booster line BL, among other return lines. A liquid portion of drilling mud and/or the mixture of drilling mud and pumped formation fluid may then be returned to the mud pit MP via the choke manifold CM and the mud-gas buster or separator MB. A gas portion may be flared, vented or otherwise disposed of at the rig S.

The surface system further includes a logging unit LU. The logging unit LU typically includes capabilities for acquiring, processing, and storing information, as well as for communicating with tool string 10 and/or other sensors such as a stand pipe pressure and/or temperature sensor SPS, a blow-out-preventer stack pressure and/or temperature sensor BS, and/or a casing shoe pressure and/or temperature sensor CSS. The logging unit LU may include a controller having an interface configured to receive commands from a surface operator. The controller in logging unit LU may further be configured to control the pumping rate of the surface pump SP.

In the shown example, the logging unit LU is communicatively coupled to an electrical wireline cable WC. The wireline cable WC is configured to transmit data between the logging unit and one or more components of a tool string (e.g., the tool string 10 in FIG. 1B). For example, one segment of the pipe string may include a side entry sub SE. The side entry sub SE may comprise a tubular device with a cylindrical shape and having an opening on one side. The side opening may allow the wireline cable WC to enter/exit the pipe string PS, thereby permitting the pipe string segments to be added or removed without having to disconnect (unlatch and latch) the wireline cable WC from surface equipment. Thus, the side entry sub SE may provide a quick and easy means to run a tool string (e.g., the tool string 10 in FIG. 1B) to a suitable depth at which formation testing may be performed without having to unlatch the wireline from the tool. While a wireline cable WC is shown in FIG. 1A to provide data communication, other means for providing data communication between the components of the tool string and the logging unit LU either ways (i.e., uplinks and/or downlinks) may be used, including Wired Drill Pipe (WDP), acoustic telemetry, and/or electromagnetic telemetry. In the shown example, the wireline cable WC is further configured to send electrical power to one or more components of the tool string 10. However, other means for providing electrical power to the components of the tool string may be used, including a mud driven turbine housed at the end of the pipe string PS.

Referring to FIG. 1B, a tool string 10 configured for conveyance in the wellbore WB extending into a subterranean formation is shown. The tool string 10 is suspended at the lower end of the pipe string PS. The tool string 10 may be of modular type. For example, the tool string 10 may include one or more of a cross-over sub, a slip joint and a diverter sub 13 fluidly connected to the interior bore in the pipe string PS. The tool string may also include a tension-compression sub, a telemetry cartridge 21, a power cartridge 22, a plurality of packer modules 23*a* and 23*b*, a plurality of pump modules 24*a* and 24*b*, a plurality of sample chamber modules 25*a*, 25*b* and 25*c*, a fluid analyzer module 26 and a probe module. For example, these later modules or cartridges may be implemented using downhole tools similar to those used in wireline operations.

As previously discussed, the diverter sub 13 comprises a fluid communicator, such as provided with a jet pump, configured to allow fluid communication with an annulus between the tool string and the wellbore wall. The jet pump includes a flow area restriction 36 disposed in the path 9 of the drilling mud towards in an interior bore of the diverter sub 13. Upon circulation of the drilling mud, the flow area restriction 36 generates a high pressure zone (e.g. above the restriction as shown in FIG. 1B) and a low pressure zone (e.g. at the restriction as shown in FIG. 1B). The diverter sub is also fluidly coupled to a main flow line 14 in which pumped formation fluid may flow. The main flow line 14 may terminate at an exit port located in the low pressure zone of the jet pump. In operations, drilling mud and formation fluid may contemporarily be pumped in the jet pump. As the exit port of the main flow line is located in the low pressure zone of the jet pump, the output pressure of the main flow line may be lower than the hydrostatic or hydrodynamic pressure of the drilling mud in the annulus between the tool string and the wall of the wellbore WB. Thus, the amount of power used for pumping formation fluid through the main flow line and into the wellbore may be reduced, or conversely, the rate at which formation fluid may be pumped through the main flow line and into the wellbore using a given amount of power may be increased. Further, as the drilling mud velocity is higher in the low pressure zone, discharging pumped formation fluid in the low pressure zone may facilitate the mixing or dilution of pumped formation fluid into the circulated drilling mud.

The telemetry cartridge 21 and power cartridge 22 may be electrically coupled to the wireline cable WC, via a logging head connected to the tool string below the slip joint (not shown). The telemetry cartridge 21 may be configured to receive and/or send data communication to the wireline cable WC. The telemetry cartridge may comprise a downhole controller (not shown) communicatively coupled to the wireline cable WC. For example, the downhole controller may be configured to control the inflation/deflation of packers (e.g., packers disposed on packer modules 23*a* and/or 23*b*), the opening/closure of valves to route fluid flowing in the main flow line in the tool string and/or the pumping of formation fluid, for example by adjusting the pumping rate of a sampling device disposed in the tool string, such as the pump module 24*b*. The downhole controller may further be configured to analyze and/or process data obtained, for example, from various sensors in disposed in the tool string (pressure/temperature gauges 30*a*, 30*b*, 31*a*, 31*b*, 32*a*, 32*b* and/or 33, fluid analysis sensors disposed in the fluid analyzer module 26, etc. . . . ), store and/or communicate measurement or processed data to the surface for subsequent analysis. The power cartridge 22 may be configured to receive electrical power from the wireline cable WC and supply suitable voltage to the electronic components in the tool string.

One or more of the pump modules (e.g., 24*a*) may be configured to pump fluid from the formation via a fluid communicator to the wellbore and into the main flow line 14 through which the obtained fluid may flow and be selectively routed to sample chambers in sample chamber modules (e.g., 25*c*), fluid analyzer modules (e.g., 26) and/or may be discharged in the wellbore as discussed above. Example implementations of the pump module may be found in U.S. Pat. No. 4,860,581 and/or U.S. Patent Application Pub. No. 2009/0044951. Additionally, one or more of the pump modules (e.g., 24*a* and/or 24*b*) may be configured to pump an inflation fluid conveyed in a sample chamber module (e.g., 25*a*, 25*b*) in and/or out of inflatable packers disposed on packers modules (e.g., 23*a* and/or 23*b*) in the tool string 10.

The fluid analyzer module 26 may be configured to measure properties or characteristics of the fluid extracted from the formation. For example, the fluid analyzer module 26 may include a fluorescence spectroscopy sensor (not shown), such as described in U.S. Patent Application Pub. No. 2008/0037006. Further, the fluid analyzer module 26 may include an optical fluid analyzer (not shown), for example as described in U.S. Pat. No. 7,379,180. Still further, the fluid analyzer module 26 may comprise a density/viscosity sensor (not shown), for example as described in U.S. Patent Application Pub. No. 2008/0257036. Yet still further, the fluid analyzer module may include a resistivity cell (not shown), for example as described in U.S. Pat. No. 7,183,778. An implementation example of sensors in the fluid analyzer module 26 may be found in a "New Downhole-Fluid Analysis-Tool for Improved Reservoir Characterization" by C. Dong et al. SPE 108566, December 2008. It should be appreciated however that the fluid analyzer module may include any combination of conventional and/or future-developed sensors within the scope of the present disclosure. The fluid analyzer module 26 may be used to monitor one or more properties or characteristics of the fluid pumped through the main flow line 14. For example, the density, viscosity, gas-oil-ratio (GOR), gas content (e.g., methane content C1, ethane content C2, propane-butane-pentane content C3-C5, carbon dioxide content CO2)), and/or water content (H2O) may be monitored.

The packer modules 23*a* and/or 23*b* may be of a type similar to the one described in "The Application of Modular Formation Dynamics Tester-MDT* with a Dual Packer Module in Difficult Conditions in Indonesia" by Siswantoro M P, T. B. Indra, and I. A. Prasetyo, SPE 54273, April 1999. The packer modules 23*a* and/or 23*b* may include a wellbore pressure and/or temperature gauge (e.g., 31*a*, 31*b*) configured to measure the pressure/temperature in the wellbore annulus. The packer modules 23*a* and/or 23*b* may also include an inflation pressure gauge (e.g., 30*a*, 30*b*) configured to measure the pressure in the packers. The packer modules 23*a* and/or 23*b* may include an inlet pressure and/or temperature gauge (e.g., 33*a*, 33*b*) configured to monitor the pressure/temperature of fluid pumped in the main flow line 14, of fluid inside two packers defining a packer interval, and/or of fluid above or below a packer. The pressure and/or temperature gauge may be implemented similarly to the gauges described in U.S. Pat. Nos. 4,547,691, and 5,394,345, strain gauges, and combinations thereof. The packer modules 23*a* and/or 23*b* may include a by-pass flow line (not shown) for establishing a wellbore fluid communication across the packer interval. In operations, the packer modules 23*a* and/or 23*b* may be used to isolate a portion of the annulus between the tool string 10 and the wall of the wellbore WB. The packer modules 23*b* may also be used to extract fluid from the formation via an inlet. A fluid communicator (e.g., including the isolation valve 34) may be configured to selectively prevent fluid communication between the main flow line 14 (and thus the tool string 10) and the wellbore annulus. While the packer modules 23*a* and/or 23*b* are shown provided with two or less inflatable packers in FIG. 1B, the packer modules 23*a* and/or 23*b* may alternatively be provided with two or more packers, for example as illustrated in U.S. patent application Ser. No. 12/202,868, filed on Sep. 2, 2008. In these cases, additional packers may be used to mechanically stabilize a sealed-off section of the wellbore (e.g., an inner interval) in which pressure testing and/or fluid sampling operations may be performed. Thus, build-up pressure measured in the stabilized sealed-off section may be less affected by transient changes of wellbore pressure around the multiple packer system.

The sample chamber module 25*a*, 25*b*, and 25*c* may comprise one or more sample chambers. For example, the sample chamber modules 25*a* and 25*b* may comprise a large sample chamber configured to convey an inflation fluid (such as water) into the wellbore. The inflation fluid may be used to inflate the packers of the packer modules 23*a* and 23*b* respectively, for example using the pump modules 24*a* and 24*b* respectively to force water into the inflatable packers. The sample chamber modules 25*c* may comprise a plurality of sample chambers configured to retain a sample of formation fluid pumped from the formation. For example, the sample chamber module 25*c* may be implemented similarly to the description of the sample chamber module described in U.S. Patent Application Pub. No 2007/0137896.

Figure 2:
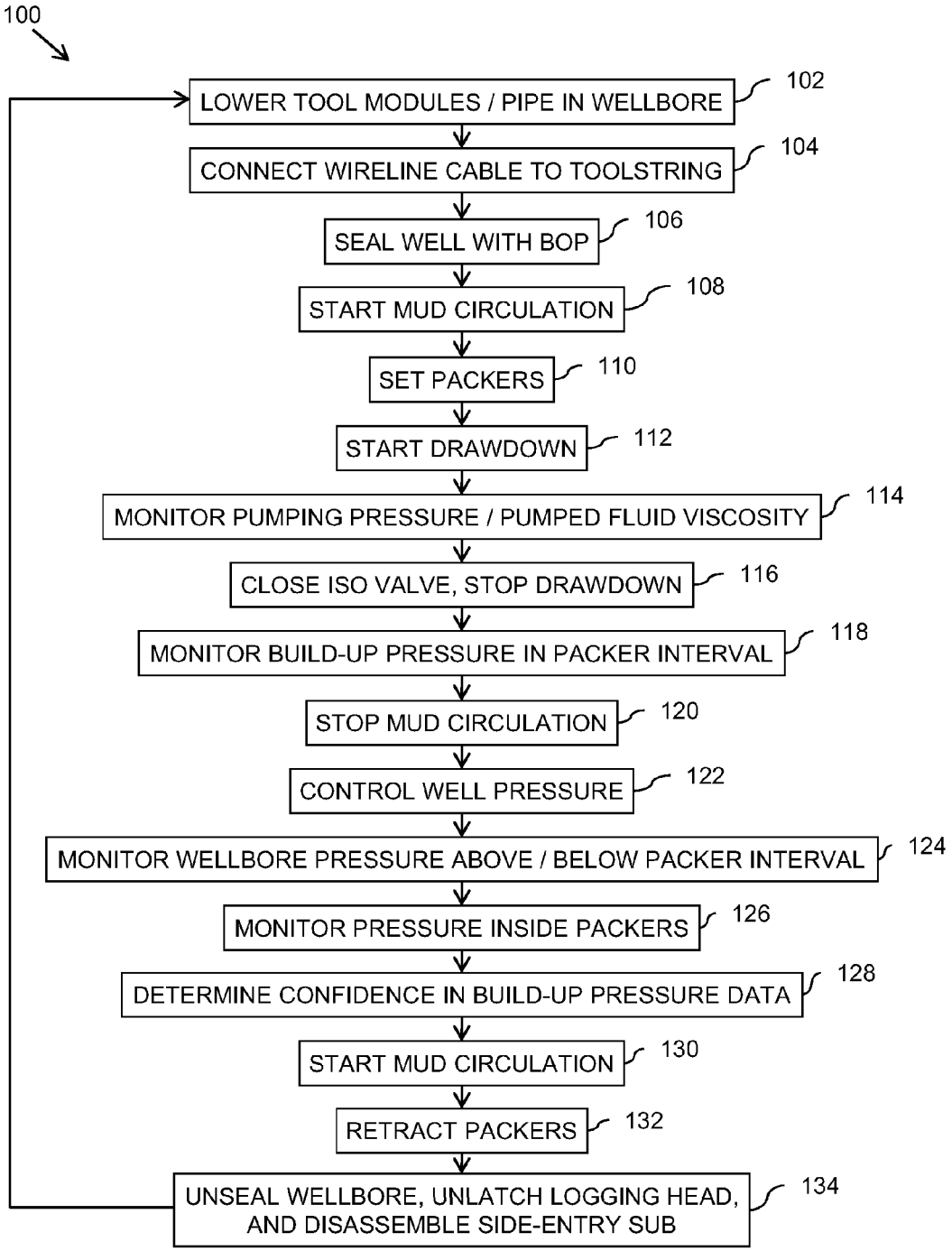
FIG. 2 is a flow-chart diagram of at least a portion of a method according to one or more aspects of the present disclosure.

FIG. 2 shows a flow chart of at least a portion of a method 100 of performing formation testing. The method 100 may be performed using, for example, the well site system of FIG. 1A and/or the tool string 10 of FIG. 1B. The method 100 may permit mixing fluid pumped from the formation and circulated drilling mud during at least a portion of a formation test, thereby alleviating well control while performing formation testing. It should be appreciated that the order of execution of the steps depicted in the flow chart of FIG. 2 may be changed and/or some of the steps described may be combined, divided, rearranged, omitted, eliminated and/or implemented in other ways.

At step 102, modules of a tool string (e.g., the modules of the tool string 10 of FIG. 1B) and segments of a pipe string (e.g., segments of the pipe string PS of FIGS. 1A and/or 1B) are assembled to form a drill string to be lowered at least partially into a wellbore. The tool string and the pipe string segments may be assembled such that to tool string is almost adjacent to the formation to be tested (e.g., the formation 40 in FIG. 1B).

At step 104, the side entry sub (e.g., the side entry sub SE of FIG. 1A), may be assembled to the rest of the drill string. The side entry sub may be operatively associated to a wireline cable (e.g., the wireline cable WC of FIGS. 1A and/or 1B). One end of the wireline cable may include a logging head. The logging head may be pumped down to the tool string (e.g., the tool string 10 of FIG. 1B) and may be latched thereto, thereby establishing an electrical communication between the modules in the tool string and a logging unit (e.g., the logging unit LU of FIG. 1A). Additional pipe segments may be added to the drill string until the tool string (for example the packer modules 23*a* and/or 23*b*) are suitably positioned in the wellbore relative to the formation to be tested (e.g., the formation 40 in FIG. 1B). However, the side entry sub position may be kept proximate at the top end of the wellbore, so that an annulus of the well may be sealed below the side entry sub. While the side entry sub SE is shown positioned above a blow-out preventer located at the sea floor in FIG. 1B, the side entry sub may alternatively be positioned above a gas handler and annular blow-out preventer (such as the gas handler and annular blow-out preventer GH of FIG. 1A), or above a diverter (such as the diverter D of FIG. 1A). For example, the side entry sub may alternatively be located above a rotary table (e.g., the rotary table RT of FIG. 1A).

At step 106, the pipe sting position is maintained. A hydraulic bladder, such as a hydraulic bladder provided with the blow-out preventer BOPS in FIG. 1A, is extended into sealing engagement against the pipe string to seal a well annulus below the side entry sub. As mentioned before, other sealing devices may be used to seal a well annulus at step 106.

At step 108, circulation of drilling mud in the well is initiated. For example, the drilling mud may be pumped form a mud pit (e.g., the mud pit MP in FIG. 1A) down into a bore of the formation testing assembly using a surface pump (e.g., the surface pump SP in FIG. 1A). The drilling mud may be introduced into the pipe string to a port in a rotary swivel (e.g., the rotary swivel SW in FIG. 1A) or through a port in a top drive. The drilling mud may then flow down in the pipe string to a downhole circulation sub (e.g., the diverter sub 13 of FIG. 1B) and back up through the well annulus. The drilling mud may then be routed to one or more return lines (e.g., the choke line CL, the kill line KL, and/or the booster line BL in FIG. 1A) towards a choke manifold (e.g., the choke manifold CM in FIG. 1A) and a mud-gas buster or separator (e.g., the mud-gas buster MB), thereby reducing the risk of the drilling venting downhole gases on the rig floor (e.g., the rig floor F in FIG. 1A). Alternatively, step 108 may be performed after step 110 described below.

At step 110, packers of the tool string (such as packers provided with the packer modules 23*a* and/or 23*b* of the tool string 10 in FIG. 1B) may be set. For example, a downhole pump (e.g., the downhole pump 24*b* in FIG. 1B) may be used to inflate the packers of a packer module (e.g., the packer module 23*b* in FIG. 1B) with an inflation fluid conveyed in a sample chamber module (e.g., the sample chamber module 25*b* in FIG. 1B). Thus, the packers may establish a fluid communication with the formation to be tested (e.g., the formation 40 in FIG. 1B). In addition, other packers may also be inflated to isolate a portion of the wellbore from pressure fluctuations caused by the circulation of drilling mud. For example, a downhole pump (e.g., the downhole pump 24*a* in FIG. 1B) may be used to inflate the packers of another packer module (e.g., the packer module 23*a* in FIG. 1B) with an inflation fluid conveyed in a sample chamber module (e.g., the sample chamber module 25*a* in FIG. 1B). As shown in FIG. 1B, the packer module 23*a* is positioned sufficiently spaced apart from the packer module 23*b* and/or sufficiently close to the circulation sub 13 so that the formation to be tested 40 is less affected by drilling mud circulation above the packer module 23*a*. In some cases, the packer module 23*a* may be set against another formation (e.g., formation 41 in FIG. 1B), known or suspected to be hydraulically isolated from the formation 40.

At step 112, the downhole tool string (e.g., the pump module 24*a* of the downhole tool string 10 in FIG. 1B) is operated to pump fluid from the formation (e.g., the formation 40) through the interval defined by a packer module (e.g., the packer module 23*b* in FIG. 1B) and into a flow line of the downhole tool string (e.g., the main flow line 14 in FIG. 1B). The fluid pumped from the formation may be mixed with circulated drilling fluid. For example, the formation fluid may be mixed in appropriate proportions with drilling mud at a diverter sub (e.g., the diverter sub 13 in FIG. 1B) as previous discussed. Thus, the formation fluid may be carried away in the drilling mud towards a mud-gas buster (e.g., the mud-gas buster MB in FIG. 1A), thereby alleviating well control while performing formation testing.

At step 114, a pressure of the fluid pumped from the formation is monitored, for example using the pressure and/or temperature gauge 33*a* in FIG. 1A. In addition, a parameter of the fluid pumped is also monitored, for example using a sensor provided with the fluid analyzer module 26 in FIG. 1B. The pumped fluid parameter may be one or more of a viscosity, a density, a gas-oil-ratio (GOR), a gas content (e.g., methane content C1, ethane content C2, propane-butane-pentane content C3-C5, carbon dioxide content CO2), and/or a water content (H2O), among other parameters. A pumped fluid viscosity value may be stored and used subsequently to determine a formation permeability from the formation fluid mobility.

At step 116, an isolation valve (e.g., the isolation valve 34 in FIG. 1B) may be closed to isolate the producing interval between the packers (e.g., the packers of the packer module 23*b*) from the tool string. The isolation valve may be closed once sufficient fluid has been pumped from the formation to be tested and halt pumping from the formation to be tested. Then, the downhole tool string may be operated to halt pumping (e.g., halt pumping by the pump module 24*a* of the downhole tool string 10 in FIG. 1B).

At step 118, build-up pressure monitoring in the producing interval isolated at step 116 is initiated. For example, the pressure and/or temperature gauge 33*a* in FIG. 1A may still be used, as the pressure and/or temperature gauge 33*a* is still in pressure communication with the producing interval when the isolation valve 34 is closed. Monitoring may continue for several hours, depending for example on how fast the pressure in the formation to be tested returns to equilibrium.

At step 120, the circulation of drilling mud may be stopped or halted. This optional step may be performed, for example, when the circulation of drilling may affect the confidence into the interpretation of build-up pressure monitored at step 118. For example, circulation of drilling fluid may induce flow of drilling mud filtrate through a mud-cake lining the wall of the wellbore penetrating the formation to be tested. The flow of drilling mud filtrate may in turn generate pressure disturbances measurable in the packer interval isolated at step 116. These pressure disturbances may negatively affect the interpretation of the pressure measurement data collected at step 118. Alternatively, step 120 may be performed prior to steps 116 and/or 118 described above.

At step 122, the well pressure may be controlled. For example, one or more mud return lines (e.g., the choke line CL, the kill line KL, and/or the booster lien BL in FIG. 1B) may be throttled, opened, or closed once the mud circulation is stopped. This step may be performed by actuating valves and/or chokes provided on return lines (e.g., chokes disposed downstream of the choke manifold CM in FIG. 1A and/or valves disposed downstream of the blow-out-preventer stack BOPS in FIG. 1A). This optional step may be performed, for example, when the fluid pumped from the formation and mixed with the drilling mud is still present in the well as circulation is interrupted, and gas contained in the mixture is suspected to come out of solution. Indeed, when the gas come out of solution, it may displace large volumes of drilling fluid out of the well (typically into the mud pit MP in FIG. 1A), reducing thereby the pressure in the drilling fluid present in the well and increasing the risk of having one or more formations produce into the well.

At step 124, the wellbore pressure above/below producing packer interval is monitored. For example, the wellbore pressure may be monitored using one or more of the pressure and/or temperature 31*a*, 31*b*, 33*b* in FIG. 1B. Additional pressure data may also be collected from sensor gauge CSS and/or BS in FIG. 1A. These wellbore pressure data may be used to determine a confidence into the interpretation of build-up pressure. For example, unbalanced wellbore pressure across one or more inflated packers may induce movement of the tool string, and/or a volume change of the producing packer interval. This volume change may in turn generate pressure disturbance at the pressure gauge 33*a*, that may not be related to the response of the formation to be tested. Thus, artifacts in the interpretation of build-up pressure that would otherwise be erroneously attributed to the response of the formation to be tested may be attributed to unbalanced wellbore pressure across one or more inflated packers.

At step 126, the pressure inside inflated packers may be monitored. For example, the inflate pressure may be monitored using pressure gauges 30*a* and/or 30*b* in FIG. 1B. The inflate pressure data may be used to determine a confidence into the interpretation of in build-up pressure. For example, rapid pressure changes inside the packers may be indicative of movement of the packers with respect to the wellbore wall, and/or movement of the tool string. These movements may induce a volume change of the producing packer interval. This volume change may in turn generate pressure disturbance at the pressure gauge 33*a*, that may not be related to the response of the formation to be tested. Thus, artifacts in the interpretation of build-up pressure that would otherwise be erroneously attributed to the response of the formation to tested may thus be attributed to movements of the packers with respect to the wellbore wall, and/or movements of the tool string.

At step 128, a confidence in the interpretation of build-up pressure data may be determined. For example, the wellbore pressure differential across packers and/or the change of inflate pressure in packers monitored at step 124 and 126 respectively may be compared to threshold values. If below the threshold value, the confidence that features observed on the build-up pressure data can be interpreted as formation response may be high. Otherwise, the confidence that features observed on the build-up pressure data can be interpreted as formation response may be low.

At step 130, the circulation of drilling mud may be restarted, for example when the monitoring of build-up pressure in producing packer interval initiated at step 118 is deemed sufficient. This step may be performed when fluid pumped from the formation and mixed with the drilling mud is still present in the well. By circulating this mixture towards a mud-gas buster or separator (e.g., the mud-gas buster MB in FIG. 1A), gas that may be present in the well may be essentially vented away from the rig floor before unsealing the well.

At step 132, the packers set at step 110 may be retracted or deflated.

At step 134, the BOP hydraulic bladder used to seal the well annulus around the pipe string at step 106 may be retracted. The logging head may be unlatched, and the side entry sub may be disassembled. Pipe segments may be added or removed for positioning the tool string in the wellbore for a formation test at another location in the same well, if desired.

Figure 3:
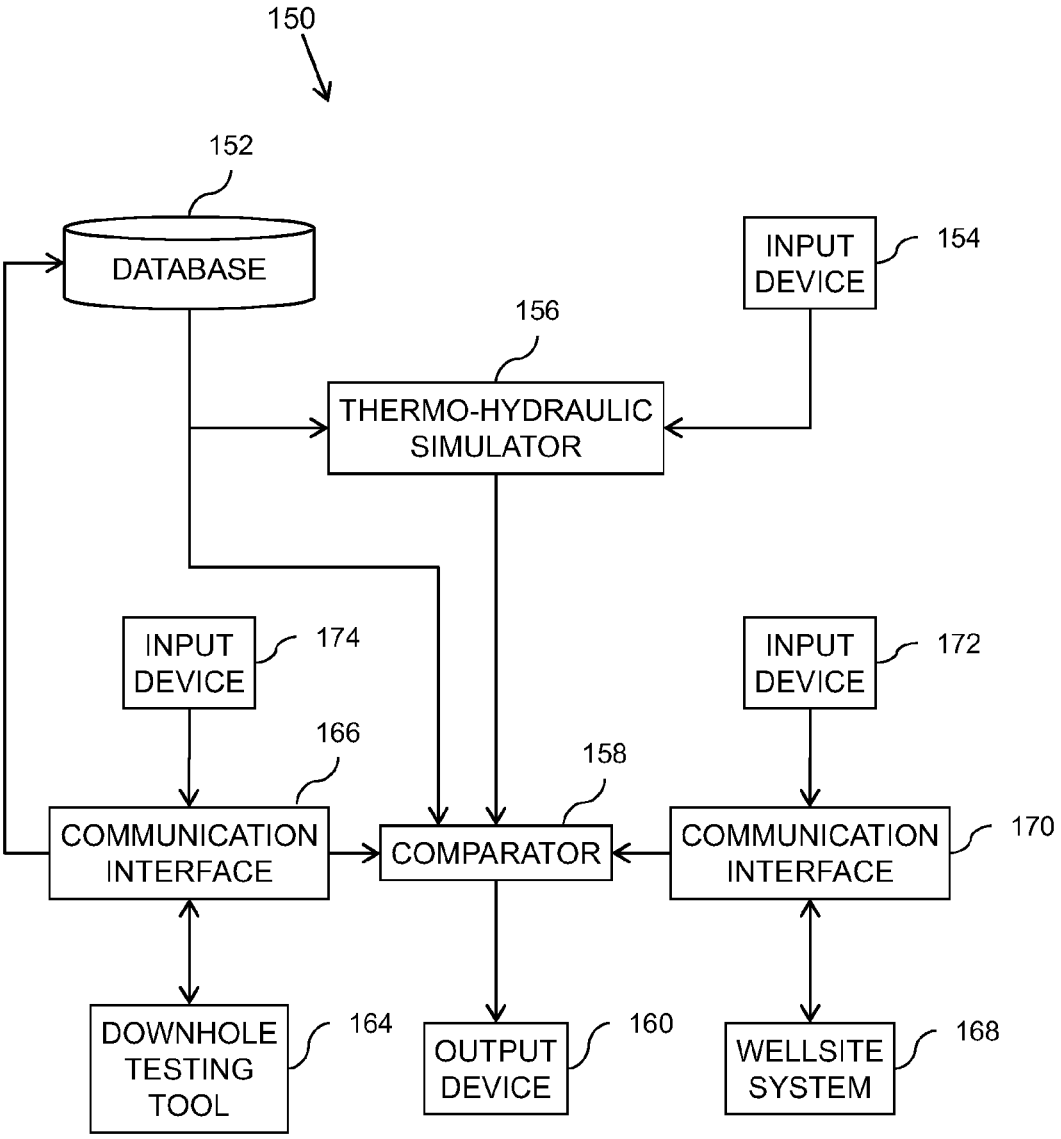
FIG. 3 is a schematic view of an apparatus according to one or more aspects of the present disclosure.

FIG. 3 shows a schematic of an example planning and monitoring system 150 according to the present disclosure. The planning and monitoring system 150 may be implemented using a combination of electrical components and software components. The planning and monitoring system 150 may be used when performing formation testing in open hole. For example, the planning and monitoring system 150 may be used in association with the well site system of FIG. 1A and/or the formation tester tool string 10 of FIG. 1B. The planning and monitoring system 150 may be configured to select operating parameter values and/or the testing tool configuration so that measurement objectives of formation testing are met, and/or to manage well control when performing formation testing.

The planning and monitoring system 150 may include a database 152. The database 152 may be configured to store formation parameters. For example, the database 152 may be used to store formation temperature data (e.g., temperature profile, sea floor temperature, geothermal gradient) along a wellbore extending into subterranean formations in which formation testing is to be performed (e.g., the wellbore WB in FIGS. 1A and 1B). The formation temperature data may have been collected during previous stages of forming the wellbore. The database 152 may also be used to store expected ranges of formation fluid data (e.g., formation fluid gas and liquid contents, formation fluid gas-oil-ratio or "GOR", formation gas and liquid densities, viscosities and/or compressibilities, formation gas and liquid solubilities in various drilling muds, bubble point pressure and temperature curves of mixtures of formation gas or liquid and various drilling muds, etc. . . . ). The formation data may have been collected during previous stages of the formation of the wellbore and/or in other well drilled in the same reservoir, analysis of fluid samples performed in surface laboratories, and/or fluid thermodynamic models. The database 152 may further be used to store estimated formation pressure, permeability and/or fracture strength data along the wellbore extending into subterranean formations in which formation testing is to be performed. The estimated formation pressure permeability and/or fracture strength data may have been collected during previous stages of the formation of the wellbore, seismic survey, among other techniques. The database 152 may still further be used to store measurement objectives of formation testing. The testing objectives may include precision requirements for build-up pressure measurements. These precision requirements may be determined from a suitable depth of investigation of the formation tests computed with well known formation models.

The planning and monitoring system 150 may include an input device 154 (such as a keyboard) configured to acquire test operating configuration and/or parameter values, for example from an operator. The input device may facilitate the iterative acquisition of test operating configuration and/or parameter values based on an estimated performance of former operating configuration and/or parameter values. For example, the input device 154 may be used to acquire diameters and length of the pipe string PS shown in FIG. 1A, diameters and length of the casing CS in FIG. 1A, the depth of the blow-out-preventer stack BOPS in FIG. 1A, diameter and length of the choke line CL, kill line KL and/or booster line BS in FIG. 1A, characteristics of valves, chokes, bladders provided on one or more of these lines (e.g., downstream the choke manifold CM in FIG. 1A) as well as the arrangement of the components of the tool string 10 of FIG. 1B. The input device 154 may also be used to acquire drilling mud composition or type (such as water based mud or "WBM", oil based mud or "OBM", etc. . . . ), drilling mud circulation temporal profile, draw-down flow rate of formation fluid induced by a downhole testing tool, draw-down duration of volume induced by the downhole testing tool, etc. . . .

The planning and monitoring system 150 may include a thermo-hydraulic simulator 156. The thermo-hydraulic simulator 156 may be configured to perform thermo-hydraulic simulations of the response of wellbore fluid conditions to operating parameter values for a range of expected formation fluid compositions. For example, the thermo-hydraulic simulator 54 may comprise a memory configured to store computer readable instructions. The computer readable instructions, when executed by a processor provided with the thermo-hydraulic simulator 156, may cause the thermo-hydraulic simulator 156 to retrieve formation temperature data and/or formation fluid data from the database 152, acquire test operating configuration and/or parameter values from the input device 154, and compute or predict a response of wellbore fluid (comprising drilling mud and/or fluid pumped from the formation) to the test operating parameter values using the test operating configuration. The response of wellbore fluid may include one or more of wellbore pressures and/or temperatures at selected locations along the well to be tested, wellbore fluid pressure and/or temperature changes applied to a testing packer interval of a downhole testing tool, dissolved and/or free gas fronts in the wellbore fluid, pit gains and gas elution rate from the well. The computed response of wellbore fluid to the test operating parameter values using the test operating configuration may be transmitted to an output device 160 for display, for example a printer or a computer visualizing screen. At least a portion of one example implementation of the thermo-hydraulic simulator 156 may include the software package SideKick, provided by Schlumberger Technology Corporation. However, other existing or future developed software packages and/or models may alternatively be used or adapted to implement the thermo-hydraulic simulator 156, such as, for example, the software packages and/or models described in the SPE papers cited in the background section of the present disclosure.

The planning and monitoring system 150 may include a comparator 158. The comparator 158 may be configured to compare the response of wellbore fluid to the test operating parameter values using the test operating configuration predicted by the thermo-hydraulic simulator 156 with data stored in the database 152. For example, during a planning phase, the comparator 158 may be used to determine whether the impact of wellbore fluid pressure and/or temperature changes applied to a testing packer interval of a downhole testing tool are indicative of uncertainty in measurement interpretation. The comparator 158 may also be used to determine whether the wellbore pressures and/or temperatures at selected locations along the well to be tested computed with the thermo-hydraulic simulator 156 are indicative of a well control and/or well stability problem. Further, the comparator 158 may be configured to compare the response of wellbore fluid to the test operating parameter values using the test operating configuration predicted by the thermo-hydraulic simulator 156 with monitored well response measured with well sensors provided with a well site system 168 and/or with downhole sensors provided with a downhole testing tool 164. For example, during a monitoring phase, the comparator 158 may further be used to determine whether the monitored wellbore fluid conditions (e.g., one or more of wellbore pressures and/or temperatures at selected locations along the well to be tested, wellbore fluid pressure and/or temperature changes applied to a testing packer interval of a downhole testing tool, dissolved and/or free gas fronts in the wellbore fluid, pit gains and gas elution rate from the well, among other measurements) deviates from expected wellbore fluid conditions (e.g., a corresponding one of the same) predicted with the thermo-hydraulic simulator 156. Still further, the comparator 158 may be configured to compare data stored in the database 152 with monitored pumped fluid characteristics measured with downhole sensors provided with a downhole testing tool 164. For example, during a monitoring phase, the comparator 158 may further be configured to determine whether one or more pumped fluid data measured with a downhole sensor provided with a downhole testing tool 164 deviates from a corresponding one of expected formation fluid data stored in the database 152. Comparisons performed by the comparator 158 may be transmitted to an output device 160, for example a visual and/or audio alarm thereof.

The planning and monitoring system 150 may include a downhole testing tool 164. The downhole testing tool 164 may be configured for conveyance in a wellbore extending into a subterranean formation. The downhole tool 164 may further be configured to pump fluid from the formation through a packer interval at selectable flow rates and for selectable durations or volumes, monitor one or more characteristics of the pumped fluid (such as pressure, temperature, density, viscosity, composition data), mix the pumped fluid with drilling mud circulated in at least a portion of the wellbore, close an isolation valve to isolate the packer interval, and measure build-up pressure data in the packer interval. For example, the downhole testing tool 164 may be implemented with the testing tool string 10 in FIG. 1B.

The planning and monitoring system 150 may include the communication interface 166. The communication interface 166 may be configured to transmit data between the downhole testing tool 164 and one or more of the database 152, the comparator 158 and/or the output device 160, and an input device 174. The communication interface 166 may be implemented using a downhole telemetry system (e.g., including the wireline cable WC in FIG. 1A and the telemetry cartridge 21 in FIG. 1B). The communication interface 166 may be used to broadcast commands received from the input interface 174 to modules of a downhole testing tool string (e.g., one or more of the modules or cartridges of the testing tool string 10 in FIG. 1B). The communication interface 166 may also be used to broadcast measurement data obtained with downhole sensors provided with the downhole testing tool 160 to one or more of the database 152, the comparator 158 and/or the output device 160. For example, the communication interface 166 may be used to broadcast fluid properties or characteristics measured with the sensors disposed in fluid analyzer module 26 in FIG. 1B, as well as pressure and/or temperature data measured with the gauges disposed in the packer modules 23*a* and/or 23*b* in FIG. 1B.

The planning and monitoring system 150 may include the input device 174, for example a keyboard located in the logging unit LU in FIG. 1A. The input device 174 may be configured to receive commands from an operator, encode and transmit these commands via the communication interface 166 to modules or cartridges of the downhole testing tool 164. For example, the input device 174 may be used to control the actuation status of the isolation valve 34 in FIG. 1B, thereby setting a predetermined draw-down duration or volume for a test. The input device 174 may be used to control the draw-down flow rate of the fluid pumped with the downhole pump 24*a* from a formation (e.g., the formation 40 in FIG. 1B) into the main flow line 14. Thus, the input device 174 may be used to adjust operating parameters (e.g., draw-down parameters) of a test performed by the downhole testing tool 164.

The planning and monitoring system 150 may include a well site system 168. The well site system 168 may be configured for conveying the downhole testing tool 164 in a wellbore extending into a subterranean formation. The well site system 168 may also be configured to circulate drilling mud from one or more drilling muds from a surface receiving device (e.g., the mud pit MP in FIG. 1A) to a downhole circulation sub (e.g., the diverter sub 13 in FIG. 1B) disposed in a pipe string suspended in the wellbore at selectable circulation rates. The well site system 168 may further be configured to monitor one or more characteristics of the wellbore fluid (such as wellbore pressures and/or temperatures at selected locations along the well to be tested, dissolved and/or free gas fronts in the wellbore fluid, pit gains and gas elution rate from the well). The well site system 168 may still further be configured to actuate (e.g., throttle, open, or close) circulation chokes, valves, or hydraulic bladders disposed on mud return lines (e.g., a riser, a choke line, a kill line, and/or a booster line). The well site system 168 may further be configured to inject different muds in the wellbore, including heavy muds formulated to kill the well. For example, the well site system 168 may be implemented with the well site system of FIG. 1A.

The planning and monitoring system 150 may include the communication interface 170. The communication interface 170 may be configured to transmit data between the well site system 168 and one or more of the comparator 158 and/or the output device 160, and an input device 172. The communication interface 170 may be implemented using wired and/or wireless communication devices. The communication interface 170 may be used to broadcast commands received from the input interface 174 to surface pump, circulation chokes, valves, or hydraulic bladders disposed on mud return lines. The communication interface 170 may also be used to broadcast measurement data obtained with well sensors provided with the well site system 168 to one or more of the comparator 158 and the output device 160. For example, the communication interface 170 may be used to broadcast measured wellbore pressures and/or temperatures at selected locations along the well, as well as data indicative of the position of dissolved and/or free gas fronts in the wellbore fluid, pit gains, and gas elution rate from the well. For example, the communication interface 170 may be used to broadcast pressure and/or temperature data measured with the gauges SPS, BS, and/or CSS in FIG. 1A.

The planning and monitoring system 150 may include the input device 172, for example a console located in the logging unit LU in FIG. 1A or in a driller's cabin. The input device 172 may be configured to receive commands from an operator, encode and transmit these commands via the communication interface 170 to a surface pump, circulation chokes, valves, or hydraulic bladders disposed on mud return lines of the well system 168. For example, the input device 172 may be used to control the circulation rate of the surface pump SP in FIG. 1A. Thus, the input device 172 may be used to adjust operating parameters of a test performed with the well site system 168.

Figure 4A:
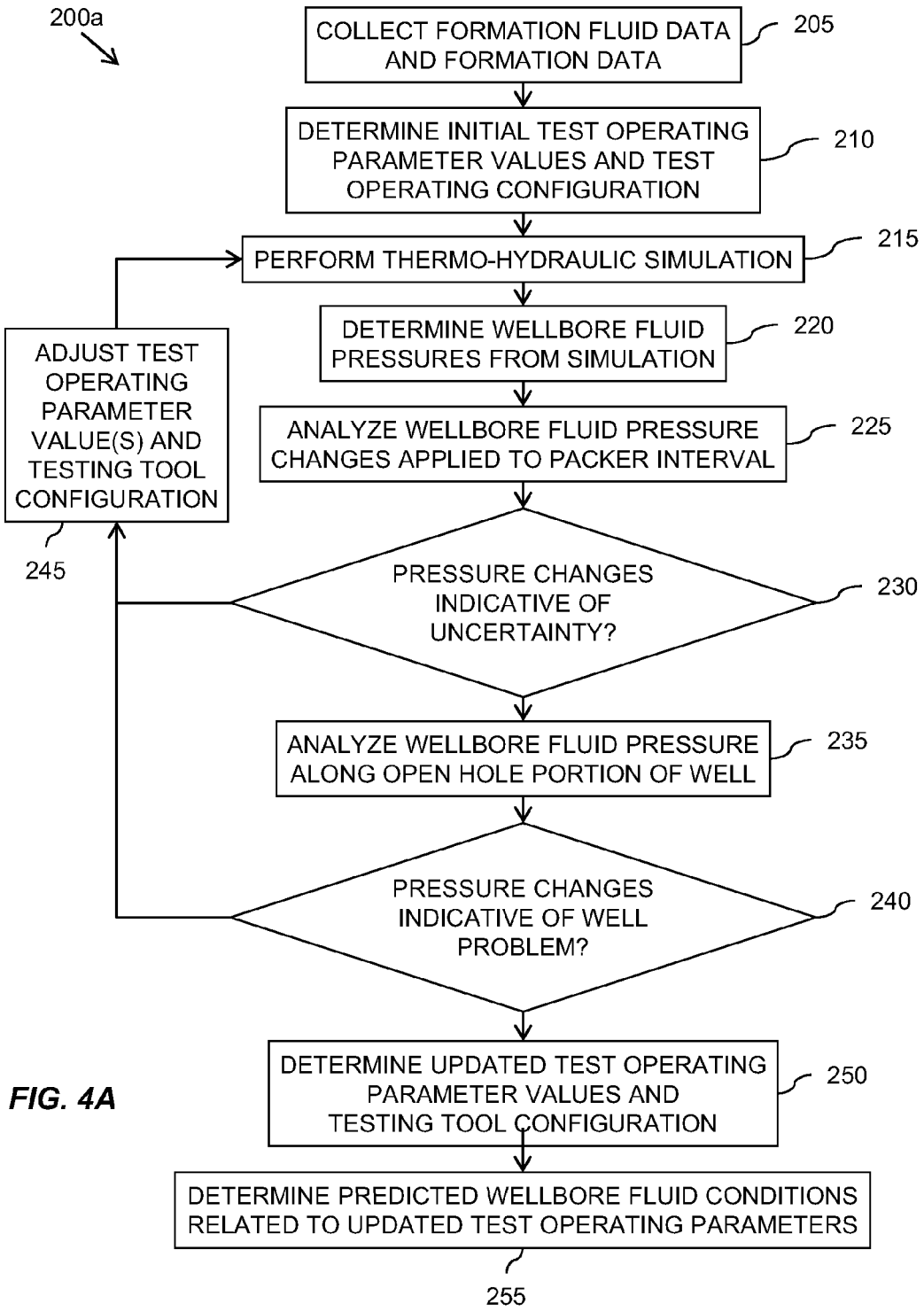
FIG. 4A is a flow-chart diagram of at least a portion of a method according to one or more aspects of the present disclosure.

FIG. 4A shows a flow chart of at least a portion of a method 200*a* of planning a formation test. The method 200*a* may be performed using, for example, the planning and monitoring system 150 of FIG. 3. It should be appreciated that the order of execution of the steps depicted in the flow chart of FIG. 4A may be changed and/or some of the steps described may be combined, divided, rearranged, omitted, eliminated and/or implemented in other ways.

At step 205, formation fluid data, such as formation fluid data described hereinabove, and/or formation temperature data, such as formation fluid data described hereinabove, may be collected. For example, formation fluid data and/or formation temperature data may be retrieved from the database 152 shown in FIG. 3.

At step 210, initial test operating parameter values, such as drilling mud composition or type, drilling mud circulation rate, formation draw-down flow rate, formation draw-down duration or volume, may be determined. Also, an initial test operating configuration, including one or more of diameters and length of a pipe string, diameters and length of a casing, a depth of a blow-out-preventer, diameter and length of choke line, kill line and/or booster line BS, characteristics of valves provided on one or more of these lines, as well as the spatial arrangement of the packers or other components of a downhole testing tool may be determined. For example, the initial test operating configuration and/or parameter values may be acquired from the input device 154 shown in FIG. 3.

At step 215, a thermo-hydraulic simulation of the response of wellbore fluid conditions to the test operating parameter values using the test operating configuration may be performed. For example, the response of wellbore fluid (comprising drilling mud and/or fluid pumped from the formation) may be computed with the thermo-hydraulic simulator 156 shown in FIG. 3.

At step 220, wellbore fluid pressure and/or temperature at selected locations along the well to be tested may be determined from the simulation performed at step 215. For example, wellbore fluid pressure and/or temperature changes applied to a testing packer interval of a downhole testing tool may be determined. Also, wellbore fluid pressures along the open hole portion of the well to be tested may be determined.

At step 225, the wellbore fluid pressure and/or temperature changes applied to the testing packer interval of a downhole testing tool and determined at step 220 may be analyzed. For example, the magnitude of the pressure variations caused by the deformation of the testing packer interval under the wellbore fluid pressure and/or temperature changes may be estimated based on, for example, laboratory tests performed using a testing packer similar to the one described in the test operating configuration used in step 210. Using the comparator 158 shown in FIG. 3, the estimated magnitude of the pressure variations may be compared to the precision requirements for build-up pressure measurements stored in the database 152 shown in FIG. 3.

At step 230, a determination whether the pressure and/or temperature changes applied to the testing packer interval are indicative of uncertainty in the measurement interpretation is made. For example, a magnitude of the pressure variations estimated at step 225 that is in excess of the precision requirements for build-up pressure measurements may indicate that the build-up pressure measurements performed under the test operating parameter values and using the test operating configuration would likely be uncertain. Conversely, the interpretation of build-up pressure measurements performed under the test operating parameter values and using the test operating configuration may likely provide reliable values of reservoir characteristics.

At step 235, the wellbore fluid pressures along the open hole portion of the well determined at step 220 may be analyzed. For example, using the comparator 158 shown in FIG. 3, the wellbore fluid pressures along the open hole portion of the well may be compared to estimated formation pressure data stored in the database 152 shown in FIG. 3. Also, still using the comparator 158 shown in FIG. 3, the wellbore fluid pressures along the open hole portion of the well may be compared to estimated formation fracture strength data stored in the database 152 shown in FIG. 3.

At step 240, a determination whether the wellbore fluid pressures along the open hole portion of the well are indicative of a well control and/or well stability problem. For example, formation pressure values that are in excess of wellbore fluid pressures anywhere in the open hole portion of the well may indicate that one or more formations penetrated by the well may start producing fluid into the well during the formation test, and thus may be indicative of a well control problem. Conversely, the well is maintained over balance, and thus no well control problem would be expected. Similarly, wellbore fluid pressures anywhere in the open hole portion of the well (and typically at the casing shoe) that are in excess of formation fracture strength may fracture and leak wellbore fluid into the fractured formation, and thus may be indicative of a well stability problem. Conversely, the wellbore pressure is maintained below the fracture strength of the formation, and thus no well stability problem would be expected.

At step 245, one or more of the test operating parameter values and the testing tool configuration may be adjusted, for example by acquiring adjusted values using the input device 154 shown in FIG. 3. The step 245 may be performed based on the determinations made at step 230 and/or 240. Thus, test operating configuration and/or parameter values may be iteratively adjusted based on the determinations made at step 230 and/or 240. For example, a drilling mud composition or type may be changed (e.g., its density may be increased or decreased). Further, drilling mud circulation rate, formation draw-down flow rate, and/or formation draw-down duration or volume may be increased or decreased. Still further, the actuation sequence (e.g., throttling magnitude and timing, opening or closing timing) of circulation chokes, of valves disposed on mud return lines (e.g., choke line, kill line, and/or booster line) may be modified. Yet still further, the spatial arrangement and/or the number of packers of a downhole testing tool may also be modified. For example, the packer modules 23*a* and/or 23*b* may be implemented using conventional dual packers, or with quad packers, such as illustrated in U.S. patent application Ser. No. 12/202,868, filed on Sep. 2, 2008. Indeed, additional packers may be used to mechanically stabilize a sealed-off section of the wellbore (e.g., an inner interval.) in which pressure testing and/or fluid sampling operations may be performed. Thus, build-up pressure measured in the stabilized sealed-off section may be less affected by transient changes of wellbore pressure around a multiple packer system.

At step 250, updated test operating parameter values and an updated testing tool configuration is determined. For example, the updated test operating parameter values and testing tool configuration may be obtained after iteration of steps 215, 220, 225, 230, 235, and 240 until the response of wellbore fluid conditions to the test operating parameter values using the test operating configuration is not indicative of uncertainty in pressure measurements and/or is not indicative of well control and stability problems.

At step 255, predicted wellbore fluid conditions related to updated test operating parameters are determined. For example, one or more of predicted wellbore pressures and/or temperatures at selected locations, predicted pit gain, predicted gas elution rate from the well may be determined.

Figure 4B:
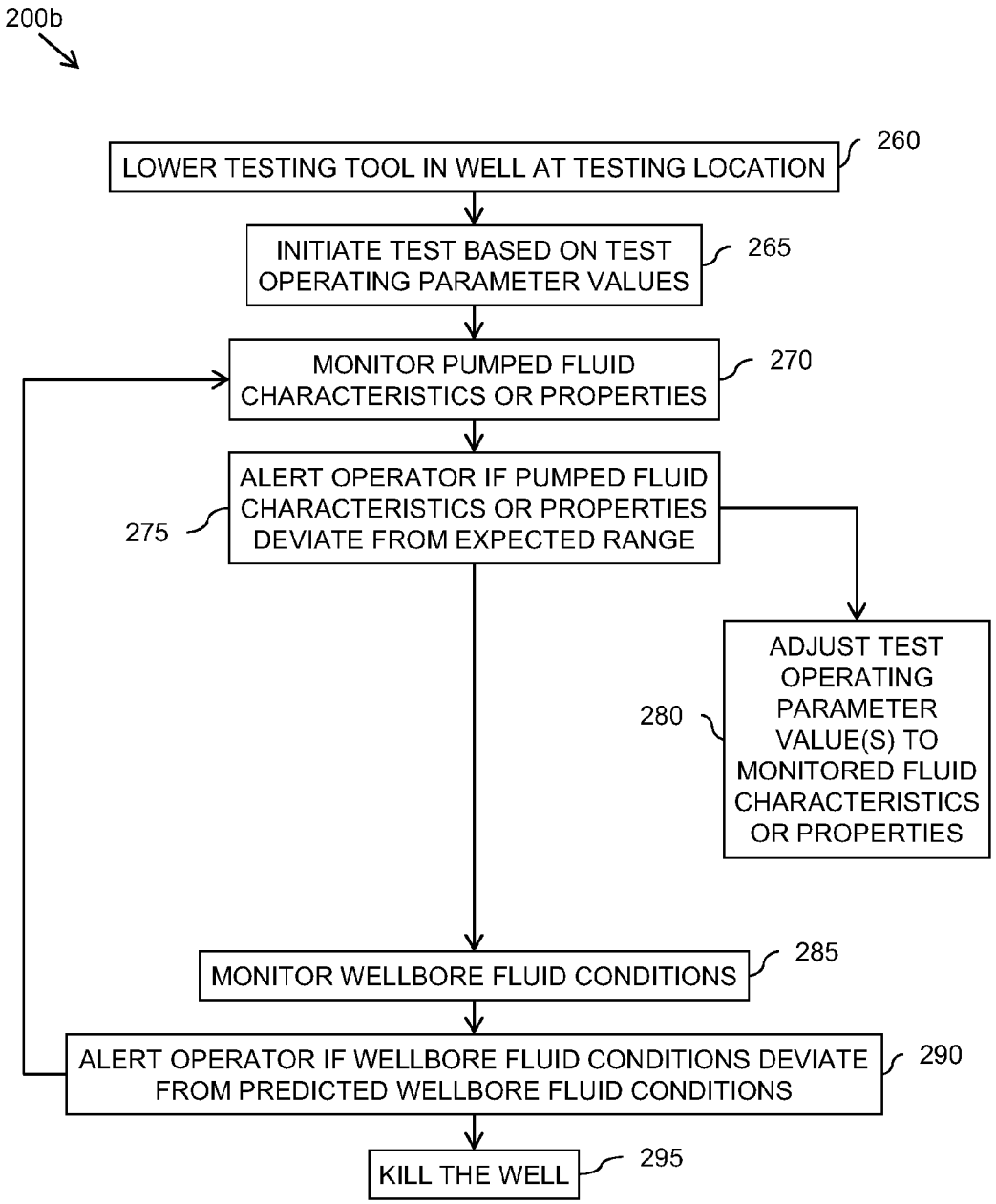
FIG. 4B is a flow-chart diagram of at least a portion of a method according to one or more aspects of the present disclosure.

FIG. 4B shows a flow chart of at least a portion of a method 200*b* of monitoring a formation test. The method 200*b* may be performed using, for example, the planning and monitoring system 150 of FIG. 3. The method 200*b* may also be performed in conjunction with the method 100 shown in FIG. 2 and/or the method 200*a* shown in FIG. 4A. It should be appreciated that the order of execution of the steps depicted in the flow chart of FIG. 4B may be changed and/or some of the steps described may be combined, divided, rearranged, omitted, eliminated and/or implemented in other ways.

At step 260, a testing tool such as the tool string 10 shown in FIG. 1B and/or the downhole testing tool 164 shown in FIG. 3 may be lowered in the well at one testing location. For example, the configuration of the testing tool may have been previously determined using the method 200*a* shown in FIG. 4A. The step 260 may involve performing the steps 102, 104 and 106 of FIG. 2.

At step 265, a test based on test operating parameter values may be initiated. For example, the test operating parameter values may have been previously determined using the method 200*a* shown in FIG. 4A. The step 265 may involve performing one or more of the steps 108, 110, 112, 114, 116, 118, 120, 122, 124, 126 and 128 of FIG. 2. The test may be initiated from the input devices 174 and/or 172 shown in FIG. 3.

At step 270, pumped fluid characteristics or properties may be monitored. For example, the downhole sensors of the downhole testing tool 164 shown in FIG. 3 may be used to measure one or more of density, viscosity, as well as composition data such as gas-oil-ratio (GOR), gas content (e.g., methane content C1, ethane content C2, propane-butane-pentane content C3-C5, carbon dioxide content CO2), and/or water content (H2O)), among other fluid characteristics or properties. As well known, other fluid characteristics or properties, such as bubble point pressure and temperature curves of formation gas or liquid may also be estimated from the above mentioned measurements or measured at step 270. The pumped fluid characteristics or properties may be broadcasted via the communication interface 166 shown in FIG. 3 and displayed on the output device 160 also shown in FIG. 3.

At step 275, an operator may be alerted if one or more of the pumped fluid characteristics or properties monitored deviate from an expected range. For example, using the comparator 158 shown in FIG. 3, the fluid characteristics or properties monitored at step 270 may be compared to corresponding expected ranges of formation fluid data stored in the database 152 shown in FIG. 3. The output device 160 shown in FIG. 3 may be configured to alert the operator if a deviation is determined.

In some cases, an operator may further perform the step 280, involving adjusting the test operating parameter values if a deviation is determined at step 275. For example, the expected ranges of formation fluid data stored in the database 152 shown in FIG. 3 may be updated using the pumped fluid characteristics or properties monitored at step 270. The method 200*a* may be performed to determine updated test operating parameter values. Alternatively, the method 200*a* may have previously performed using a variety of expected ranges of formation fluid data to produce corresponding updated test operating parameter values. An operator may use the updated test operating parameter values to affect the operations of the downhole testing tool 164 and/or the well site system 168 of FIG. 3 via the input devices 174 and/or 172 shown in FIG. 3.

At step 285, wellbore fluid conditions are monitored. For example, pit gain, gas elution rate from the well at or wellbore pressure and/or temperatures may be measured using well sensors of the well site system 168 shown in FIG. 3 and or downhole sensors of the downhole testing tool 164 shown in FIG. 3.

At step 290, an operator may be alerted if one or more the wellbore fluid conditions deviate from a corresponding one of predicted wellbore fluid conditions. For example, the predicted wellbore fluid conditions may have been determined using the method 200*a* shown in FIG. 4A. Using the comparator 158 shown in FIG. 3, the wellbore fluid conditions monitored at step 285 may be compared to the predicted wellbore fluid conditions computed with the thermo-hydraulic simulator 156 shown in FIG. 3. The output device 160 shown in FIG. 3 may be configured to alert the operator if a deviation is determined.

In some cases, an operator may further perform the step 295 involving killing the well if a deviation is determined at step 290.

The operations described in steps 270, 275 and optionally 280 may be repeated as long as fluid pumping from the formation is performed. The operations described in steps 285, 290 and optionally 295 may be repeated as long as long as a formation test is performed.

In view of all of the above and accompanying figures, it should be readily apparent to those skilled in the art that the present disclosure introduces a method comprising: collecting formation temperature data along a wellbore extending into a subterranean formation using a downhole tool; determining test operating parameter values; performing a wellbore hydraulic simulation of a response of wellbore fluid conditions to the test operating parameter values and the formation temperature data; determining whether the response of wellbore fluid conditions is indicative of a well control or stability problem; and initiating a test based on the determination of whether the response of wellbore fluid conditions is indicative of a well control or stability problem. At least one of the test operating parameters may be selected from the group consisting of mud composition, mud type, drawdown duration, and drawdown volume. The method may further comprise determining a test operating configuration, wherein the wellbore hydraulic simulation is performed using the test operating configuration. The test operating configuration may comprise at least one of: a packer spatial arrangement of a downhole testing configuration; and a number of packers of the downhole testing configuration. Determining whether the response of wellbore fluid conditions is indicative of a well control or stability problem may comprise: collecting formation pressure data; determining a wellbore pressure profile from the simulation; and comparing at least a portion of the collected formation pressure data with at least a portion of the wellbore pressure profile. The method may further comprise adjusting at least one of the test operating parameter values based on the determination of whether the wellbore pressure profile is indicative of a well control or stability problem. The method may further comprise repeating the performing step after the adjusting step. The method may further comprise predicting a well response related to at least one test operating parameter value from the simulation. The predicted well response may comprise one or more of wellbore pressures at selected locations, wellbore temperature at selected locations, pit gains, and gas elution rate.

The present disclosure also introduces apparatus comprising: means for collecting formation temperature data along a wellbore extending into a subterranean formation; means for determining test operating parameter values; means for performing a wellbore hydraulic simulation of a response of wellbore fluid conditions to the test operating parameter values and the formation temperature data; means for determining whether the response of wellbore fluid conditions is indicative of a well control or stability problem; and means for initiating a test based on the determination of whether the response of wellbore fluid conditions is indicative of a well control or stability problem.

The present disclosure also provides a method involving collecting formation temperature data along a wellbore extending into a subterranean formation, determining test operating parameter values, performing a wellbore hydraulic simulation of the response of wellbore fluid conditions to the test operating parameter values and the formation temperature data, determining whether the response of wellbore fluid conditions is indicative of one of a well control and a well stability problem, and initiating a test based on the determination whether the response of wellbore fluid conditions is indicative of one of a well control and a well stability problem. At least of the test operating parameters may be selected from the group consisting of mud composition, mud type, mud circulation rate, drawdown flow rate, drawdown duration, and drawdown volume. The method may further comprise determining a test operating configuration, and the wellbore hydraulic simulation may be performed using the test operating configuration. The test operating configuration may comprise at least one of a packer spatial arrangement of a downhole testing configuration, and a number of packers of the downhole testing configuration. Determining whether the response of wellbore fluid conditions is indicative of one of a well control and a well stability problem may comprise collecting formation pressure data, determining a wellbore pressure profile from the simulation, and comparing at least a portion of the collected formation pressure data with at least a portion of the wellbore pressure profile. The method may further comprise adjusting at least one of the test operating parameter values based on the determination whether the wellbore pressure profile is indicative of one of a well control and a well stability problem. The method may further comprise repeating the performing step after the adjusting step. The method may further comprise predicting a well response related to at least one test operating parameter values from the simulation. The predicted well response may comprise one or more of wellbore pressures at selected locations, wellbore temperature at selected locations, pit gains, and gas elution rate. The method may further comprise pumping formation fluid from the formation using the downhole tool, monitoring composition of the pumped formation fluid, adjusting the test operating parameter values based on the monitored composition of the pumped formation fluid, and continuing the test using the adjusted operating parameter values. The method may further comprise alerting an operator when the monitored composition of the pumped formation fluid deviates from an expected composition. The method may further comprise monitoring a pumped formation fluid parameter. The pumped formation fluid parameter may be at least one of a viscosity, a density, and an optical property. The method may further comprise predicting at least one of a wellbore pressure and a wellbore temperature at a predetermined location from the simulation, and monitoring at least one of the wellbore pressure and the wellbore temperature at the predetermined location. The predetermined location is selected from the group consisting of a downhole tool location, blow-out-preventer location, and a casing shoe location. The method may further comprise alerting an operator when the at least one of monitored wellbore pressure and monitored wellbore temperature deviates from the corresponding predicted one of wellbore pressure and wellbore temperature. The method may further comprise killing the well when the at least one of monitored wellbore pressure and monitored wellbore temperature deviates from the corresponding predicted one of wellbore pressure and wellbore temperature. The method may further comprise predicting a pit gain from the simulation, and monitoring a pit gain. The method may further comprise alerting an operator when the monitored pit gain deviates from the predicted pit gain. The method may further comprise killing the well when the monitored pit gain deviates from the predicted pit gain. The method may further comprise predicting a gas elution rate from the simulation, and monitoring a gas elution rate. The method may further comprise alerting an operator when the monitored gas elution rate deviates from the predicted gas elution rate. The method may further comprise killing the well when the monitored gas elution rate deviates from the predicted gas elution rate. The method may further comprise closing a blow-out-preventer around the drill string. The method may further comprise controlling a flow rate in a mud return flow line. The method may further comprise setting two packers defining a packer interval before operating the tool string to pump formation fluid from the formation through the packer interval, closing an isolation valve to isolate the packer interval, halting pumping of the formation fluid, and monitoring build-up pressure in the packer interval. The method may further comprise monitoring at least one of a wellbore pressure above and below the packer interval. The method may further comprise setting a third packer above the packer interval. The method may further comprise monitoring at least one of a wellbore pressure above and below the third packer. The method may further comprise determining a confidence in build-up pressure data based on at least one of monitored wellbore pressure above the packer interval, monitored wellbore pressure below the packer interval, and monitored pressure inside one or more packers defining the packer interval.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method comprising:

collecting formation temperature data along a wellbore extending into a subterranean formation using a downhole tool;

performing a wellbore hydraulic simulation, using a processor, of a response of wellbore fluid conditions to initial test operating parameter values and the formation temperature data;

determining, using the processor, whether the response of wellbore fluid conditions is indicative of a well control or stability problem at least partly by:

retrieving into the processor formation pressure data acquired by the downhole tool or by another downhole tool;

determining, using the processor, a wellbore pressure profile from the simulation; and comparing, using the processor, at least a portion of the formation pressure data with at least a portion of the wellbore pressure profile to identify whether the response of wellbore fluid conditions is indicative of a well control or stability problem; and initiating a test based on the determination of whether the response of wellbore fluid conditions is indicative of a well control or stability problem.

2. The method of claim 1, wherein at least one of the test operating parameters comprises mud composition, mud type, drawdown duration, or drawdown volume, or any combination thereof.

3. The method of claim 1, comprising determining a test operating configuration, wherein the wellbore hydraulic simulation is performed using the test operating configuration.

4. The method of claim 3, wherein the test operating configuration comprises at least one of:

a packer spatial arrangement of a downhole testing configuration; and a number of packers of the downhole testing configuration.

5. The method of claim 1, comprising adjusting at least one of the test operating parameter values based on the determination of whether the wellbore pressure profile is indicative of a well control or stability problem.

6. The method of claim 5, comprising repeating the performing step after the adjusting step.

7. The method of claim 1, comprising predicting a well response related to at least one test operating parameter value from the simulation.

8. The method of claim 7, wherein the predicted well response comprises one or more of wellbore pressures at selected locations, wellbore temperature at selected locations, pit gains, or gas elution rate, or any combination thereof.

9. An apparatus, comprising:

means for collecting formation temperature data along a wellbore extending into a subterranean formation;

means for determining test operating parameter values;

means for performing a wellbore hydraulic simulation of a response of wellbore fluid conditions to the test operating parameter values and the formation temperature data;

means for determining whether the response of wellbore fluid conditions is indicative of a well control or stability problem; and means for initiating a test based on the determination of whether the response of wellbore fluid conditions is indicative of a well control or stability problem.

10. The apparatus of claim 9, wherein at least one of the test operating parameters comprises mud composition, mud type, drawdown duration, or drawdown volume, or any combination thereof.

11. The apparatus of claim 9, wherein the wellbore hydraulic simulation is performed based on an initial test operating configuration, wherein the initial test operating configuration comprises a packer spatial arrangement of a downhole testing configuration or a number of packers of the downhole testing configuration, or a combination thereof.

12. The apparatus of claim 9, wherein the means for determining whether the response of wellbore fluid conditions is indicative of a well control or stability problem comprise:

means for obtaining formation pressure data;

means for determining a wellbore pressure profile from the simulation; and means for comparing at least a portion of the formation pressure data with at least a portion of the wellbore pressure profile to identify whether the response of wellbore fluid conditions is indicative of a well control or stability problem.

13. The apparatus of claim 9, comprising means for adjusting at least one of the test operating parameter values based on the determination of whether the wellbore pressure profile is indicative of a well control or stability problem.

14. The apparatus of claim 9, comprising means for predicting a well response related to at least one test operating parameter value from the simulation, wherein the predicted well response comprises wellbore pressures at multiple locations, wellbore temperature at multiple locations, pit gains, or gas elution rate, or any combination thereof.

15. One or more tangible, non-transitory machine-readable media comprising instructions executable by a processor to:

retrieve, into the processor, formation temperature data along a wellbore extending into a subterranean formation collected using a first downhole tool;

perform, using the processor, a wellbore hydraulic simulation of a response of wellbore fluid conditions to initial test operating parameter values and the formation temperature data;

determine, using the processor, whether the response of wellbore fluid conditions is indicative of a well control or stability problem at least in part by:

obtaining formation pressure data;

determining a wellbore pressure profile from the simulation; and comparing at least a portion of the formation pressure data with at least a portion of the wellbore pressure profile to identify whether the response of wellbore fluid conditions is indicative of a well control or stability problem; and indicate whether the response of wellbore fluid conditions is indicative of the well control or stability problem.

16. The one or more media of claim 15, wherein at least one of the test operating parameters comprises mud composition, mud type, drawdown duration, or drawdown volume, or any combination thereof.

17. The one or more media of claim 15, wherein the instructions to perform the wellbore hydraulic simulation cause the wellbore hydraulic simulation to be performed based on an initial test operating configuration, wherein the initial test operating configuration comprises a packer spatial arrangement of a downhole testing configuration or a number of packers of the downhole testing configuration, or a combination thereof.

18. The one or more media of claim 15, comprising instructions to adjust at least one of the test operating parameter values based on the determination of whether the wellbore pressure profile is indicative of a well control or stability problem.

19. The one or more media of claim 18, comprising instructions to repeat the performance instructions after the adjusting instructions.

20. The one or more media of claim 15, comprising instructions to predict a well response related to at least one test operating parameter value from the simulation, wherein the predicted well response comprises wellbore pressures at multiple locations, wellbore temperature at multiple locations, pit gains, or gas elution rate, or any combination thereof.

* * * * *